US006848590B2

(12) United States Patent
Brozell et al.

(10) Patent No.: US 6,848,590 B2
(45) Date of Patent: Feb. 1, 2005

(54) CHILD-RESISTANT CLOSURE AND CONTAINER PACKAGE

(75) Inventors: Brian J. Brozell, Maumee, OH (US); Robert A. Perry, Toledo, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 78 days.

(21) Appl. No.: 09/982,249

(22) Filed: Oct. 16, 2001

(65) Prior Publication Data

US 2003/0121877 A1 Jul. 3, 2003

(51) Int. Cl.[7] ..... B65D 41/04; B65D 55/02

(52) U.S. Cl. ..... 215/220; 215/330; 215/331; 215/343; 215/344; 215/346

(58) Field of Search ..... 215/220, 330, 215/344, 346, 331, 343

(56) References Cited

U.S. PATENT DOCUMENTS

| | | | | |
|---|---|---|---|---|
| 3,739,933 A | | 6/1973 | Degaetano | |
| 3,880,313 A | | 4/1975 | Akers | |
| 3,907,145 A | | 9/1975 | Horvath | |
| 3,917,096 A | | 11/1975 | Hedgewick | |
| 4,032,028 A | | 6/1977 | Reiss et al. | |
| 4,084,717 A | | 4/1978 | King | |
| 4,090,629 A | | 5/1978 | Hedgewick | |
| 4,091,948 A | | 5/1978 | Northup | |
| 4,139,112 A | | 2/1979 | Cooke | |
| 4,320,844 A | | 3/1982 | Cooper | |
| 4,353,475 A | | 10/1982 | Kachur | |
| 4,375,858 A | | 3/1983 | Shah | |
| 4,387,817 A | | 6/1983 | Wiles et al. | |
| 4,456,136 A | | 6/1984 | Palsson | |
| 4,522,307 A | | 6/1985 | Steiner | |
| 4,567,992 A | | 2/1986 | Davis | |
| 4,935,273 A | * | 6/1990 | Ou-Yang | 428/35.7 |
| 5,135,124 A | | 8/1992 | Wobser | |
| 5,449,078 A | | 9/1995 | Akers | |
| 5,462,186 A | | 10/1995 | Ladina et al. | |
| 5,819,967 A | | 10/1998 | Lo | |
| 5,938,055 A | | 8/1999 | Philips | |
| 6,015,054 A | | 1/2000 | King et al. | |

FOREIGN PATENT DOCUMENTS

DE 2625875 A1 12/1977

OTHER PUBLICATIONS

"SP–400 Finish for Plastic Bottles," The Plastic Bottle Institute, Drawing SP–400 (1976).
"Continuous Thread Plastic Closures for Glass and Plastic 400 Finishes," Closure Manufacturing Association, Drawing PC–4002 (1995).

* cited by examiner

*Primary Examiner*—Lee Young
*Assistant Examiner*—Niki M. Eloshway

(57) ABSTRACT

A child-resistant closure and container package includes a container having a finish with an external thread and pockets in the thread. A closure has a base wall, a peripheral skirt with an internal thread and lugs on the internal thread for receipt in the pockets, and a spring element on the base wall for engagement with the container finish to bias the closure away from the container finish and resiliently urge the lugs into the pockets. A liner is urged by the spring element into engagement with the container finish. The liner may include a base with metal and plastic layers for induction-welded sealing engagement with the finish such that, upon removal of the closure, the metal and plastic layers remain secured to the finish and the liner base is removed with the closure. The metal and plastic layers may be removed by a user for access to the contents of the container, and the liner base continues to serve as a package seal during use of the package.

31 Claims, 9 Drawing Sheets

CHILD-RESISTANT CLOSURE AND CONTAINER PACKAGE

The present invention is directed to child-resistant closure and container packages, to closures and containers for such packages, and to methods of making such packages, closures and containers.

BACKGROUND AND SUMMARY OF THE INVENTION

Child-resistant closure and container packages are conventionally employed for prescription vials, vitamin bottles and a number of other applications. The present invention deals particularly with those types of child-resistant packages that involve application of axial pressure to the closure and simultaneous turning of the closure with respect to the container in order to remove the closure from the container. The present invention involves a number of features or aspects in a child-resistant closure, container or package, which may be implemented separately from or more preferably in combination with each other.

The present invention embodies a number of features or aspects that may be used separately from or, more preferably, in combination with each other. In accordance with a first aspect of the present invention, a child-resistant closure and container package includes a container having a finish with at least one external thread and pockets in the thread. A closure has a base wall, a peripheral skirt with at least one internal thread and lugs on the internal thread for receipt in the pockets, and a spring element on the base wall for engagement with the container finish to bias the closure away from the container finish and resiliently urge the lugs into the pockets. A liner preferably is urged by the spring element into engagement with the container finish. The liner may include a base with metal and plastic layers for induction-welded sealing engagement with the finish such that, upon removal of the closure, the metal and plastic layers remain secured to the finish and the liner base is removed with the closure. The metal and plastic layers may be removed by a user for access to the contents of the container, and the liner base continues to serve as a package seal during use of the package. The package may alternatively be supplied with a mono-layer liner, or without a liner.

In accordance with another aspect of the present invention, the pockets in the at least one external thread on the container finish are formed on an undersurface of the external thread and do not extend axially through the thread, such that the upper surface of the external thread is continuous throughout the external thread. This feature helps prevent cross threading during application of the closure to the container finish. In accordance with a further feature of the invention, the at least one external thread on the container finish and the at least one internal thread on the closure skirt may be of elongated dimension as compared with industry standards, and thread abutment stops are formed on the ends of the threads to prevent over-tightening of the closure and potential damage to the spring element. The elongated external thread on the container finish, particularly in combination with the pockets that do not extend axially through the external thread, permits the container to be used with a conventional non-child-resistant closure if desired, for example, by elderly persons. In dual lead packages, each thread on the closure may extend over an arc of 190° for example, and each thread on the finish may extend over an arc of 180°. In a single lead package with the thread stop at the bottom of the thread on the container finish, the closure thread may extend over an arc of 450° and the finish thread may extend over an arc of 455°. In single lead packages with the thread stop at the top of the closure thread, the closure thread may extend over an arc of 370° and the finish thread may extend over an arc of 360°.

A closure in accordance with a further aspect of the present invention is of integrally molded plastic construction. The closure has a base wall, a peripheral skirt with at least one internal thread and lugs on an upper surface of the thread, and a spring element on the base wall for engagement with a container finish to bias the lugs into opposing thread pockets on the container finish. The lugs have an angulated surface sloping toward an end of the thread remote from the base wall and a circumferentially facing radially extending abutment surface on an end of the lugs facing the opposing end of the thread. The spring element preferably comprises a circumferentially continuous conical lip that extends radially and axially inwardly from the base wall adjacent to the skirt. The lip tapers in thickness from the base wall to the free end of the lip to promote differential flexing of the lip upon engagement with a container finish or with a liner in opposed engagement with the container finish. The free end of the lip is rounded to permit sliding of the lip along the surface of a liner without binding or tearing. A container in accordance with yet another aspect of the invention includes an integrally molded plastic body having a finish with at least one external thread and pockets on an undersurface of the thread that do not extend axially through the thread, such that the upper surface of the thread is continuous throughout the thread. The pockets in the external thread have a circumferentially extending axially angulated cam surface and a radially extending abutment surface opposed to the cam surface.

BRIEF DESCRIPTION OF THE DRAWING

The invention, together with additional objects, features and advantages thereof, will be best understood from the following description, the appended claims and the accompanying drawing in which:

DETAILED DESCRIPTION OF PREFERRED EMBODIMENTS

Figure 1:
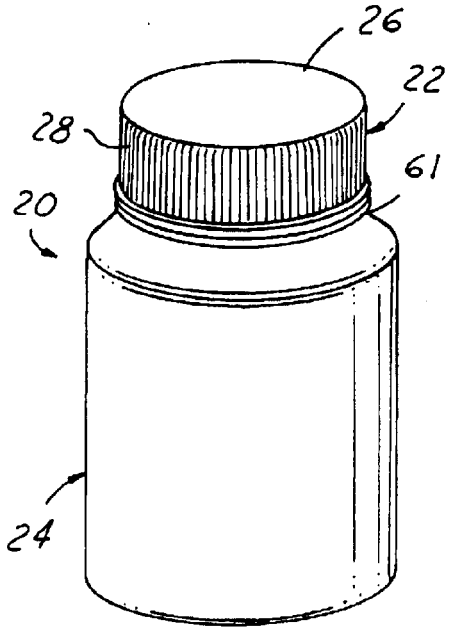
FIG. 1 is a perspective view of a closure and container package in accordance with one presently preferred embodiment of the invention.
Figure 3:
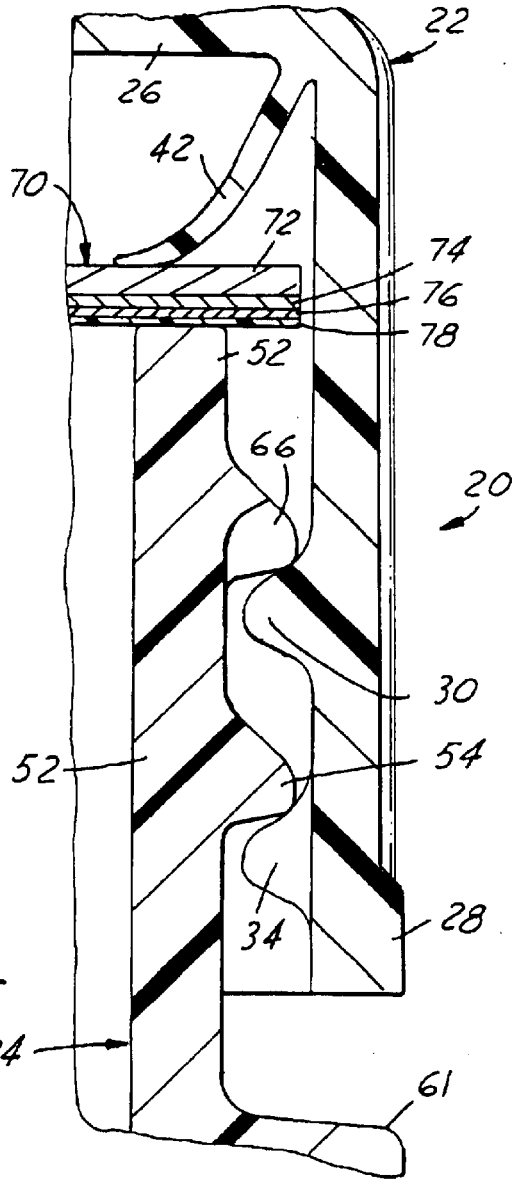
FIG. 3 is an enlarged sectional view of the portion of FIG. 2 within the area 3.
Figure 2:
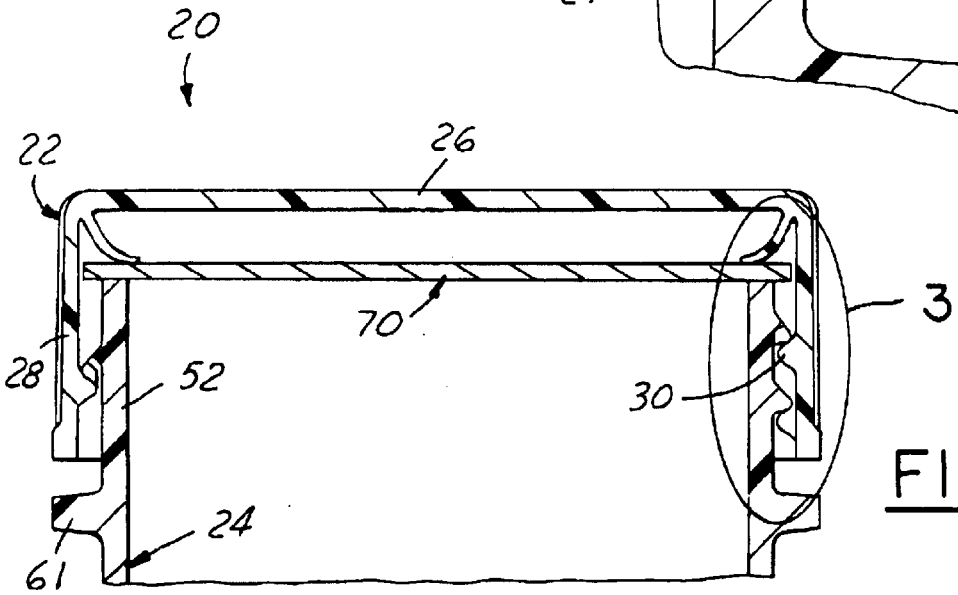
FIG. 2 is a fragmentary sectional view of the closure and container finish in the package of FIG. 1.
Figure 4:
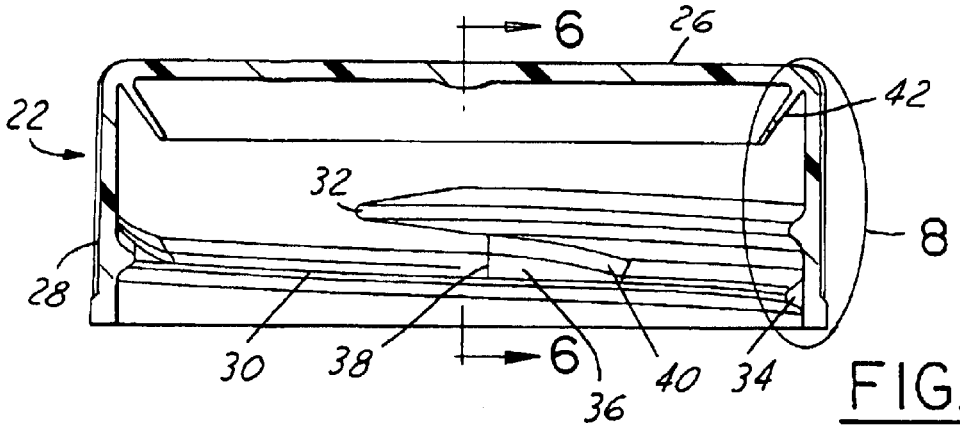
FIG. 4 is a sectioned elevational view of the closure in the package of FIGS. 1–3.

FIG. 1 illustrates a child-resistant closure and container package 20 in accordance with one presently preferred embodiment of the invention as comprising a closure 22 threadably secured to the finish of a container 24. Closure 22 (FIGS. 1–9) is preferably of integrally molded plastic construction having a circular base wall 26 and a depending peripheral skirt 28. An internal helical thread 30 extends around the inside surface of peripheral skirt 28 between an upper end 32 and a lower end 34 adjacent to the free edge of peripheral skirt 28. (Directional adjectives such as "upper" and "lower" are employed by way of description and not limitation with reference to the vertical and upstanding orientations of the closure and container illustrated in the drawings. Thus, upper end 32 of thread 30 is adjacent to closure base wall 26, while lower thread end 34 is adjacent to the free edge of skirt 28.) Upper end 32 of thread 30 contains the usual tapered thread lead-in, while lower end 34 is flat, faces circumferentially and is disposed in the plane of the diameter of the closure. A plurality of circumferentially spaced lugs 36 are formed on the upper surface of thread 30. The illustrated embodiment includes a single internal thread 30 having four lugs 36 at 90° spacing from each other, with the first lug being spaced 90° from thread end 32. Each lug 36 has a flat circumferentially oriented abutment surface 38 disposed in a plane that includes the closure axis, and a sloping cam surface 40 facing in the opposite direction from abutment surface 38. In the illustrated embodiment of the invention, the profile of lug 36 follows the thread helix angle for about 5°, and then tangentially tapers into the thread over an angle of 25°.

Figure 5:
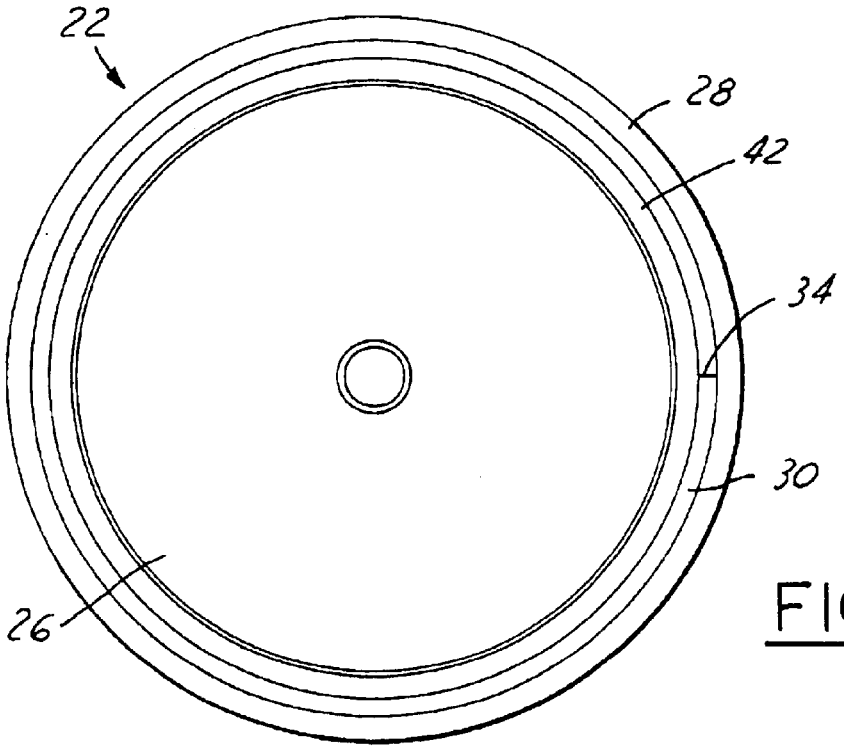
FIG. 5 is a bottom plan view of the closure illustrated in FIG. 4.
Figure 6:
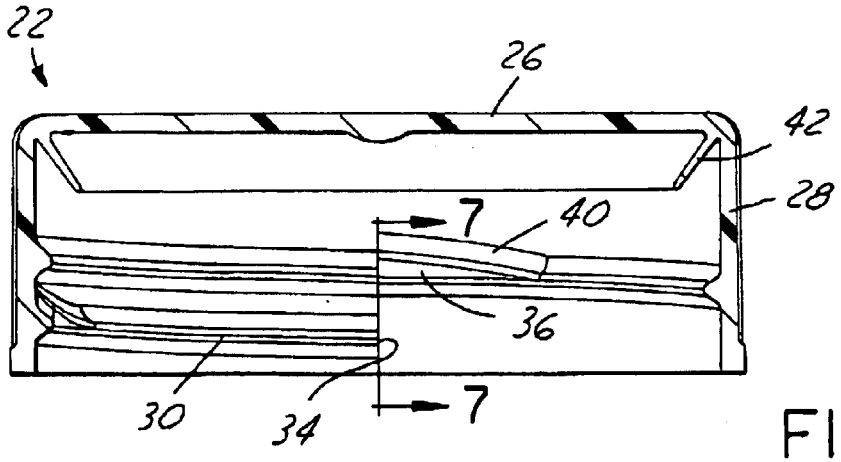
FIG. 6 is a sectional view taken substantially along the line 6—6 in FIG. 4.
Figure 7:
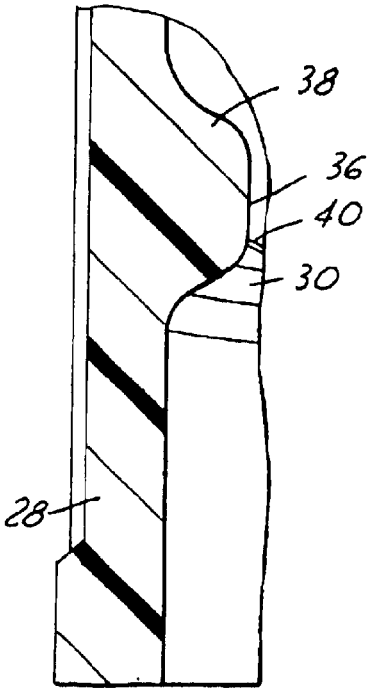
FIG. 7 is a fragmentary sectional view taken substantially along the line 7—7 in FIG. 6.
Figure 9:
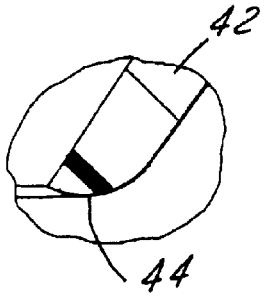
FIG. 9 is a fragmentary sectional view of the portion of FIG. 8 within the circle 9.
Figure 8:
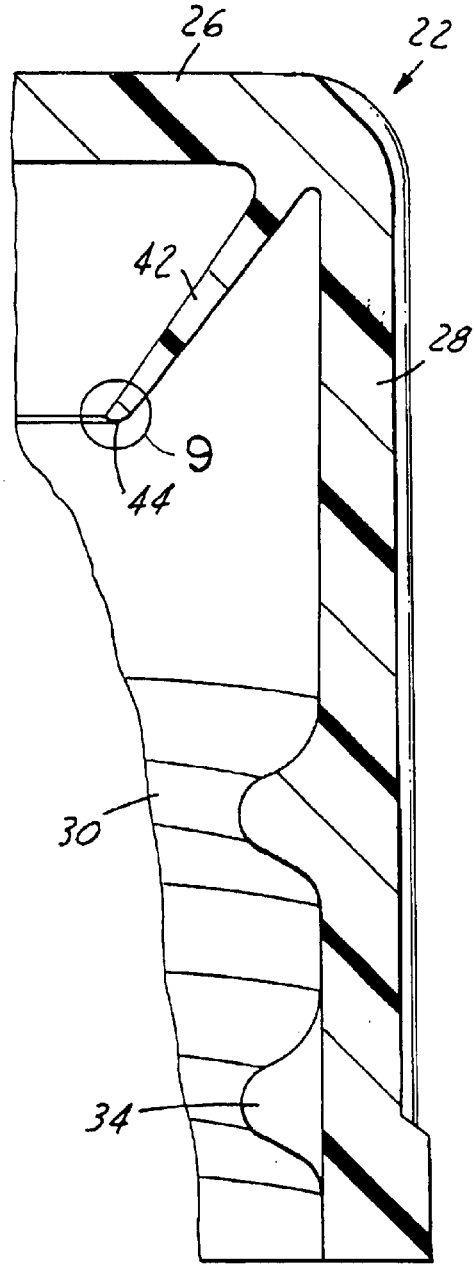
FIG. 8 is a fragmentary sectional view on an enlarged scale of the portion of FIG. 4 within the area 8.
Figure 10:
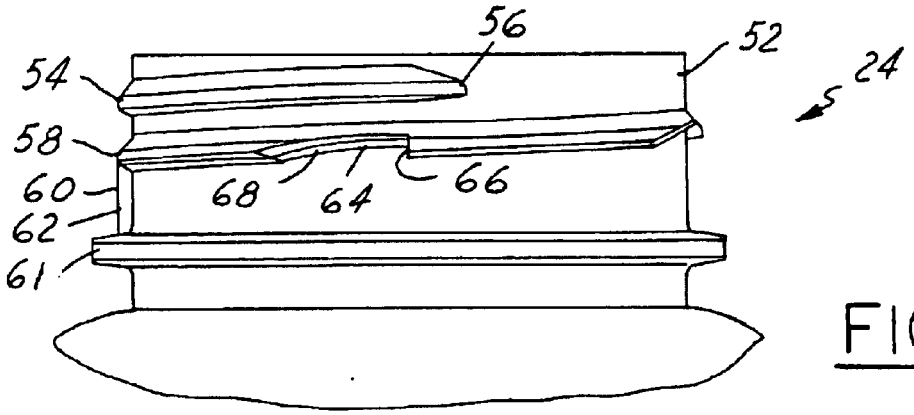
FIG. 10 is a fragmentary elevational view of the finish of the container in the package of FIGS. 1–3.
Figure 11:
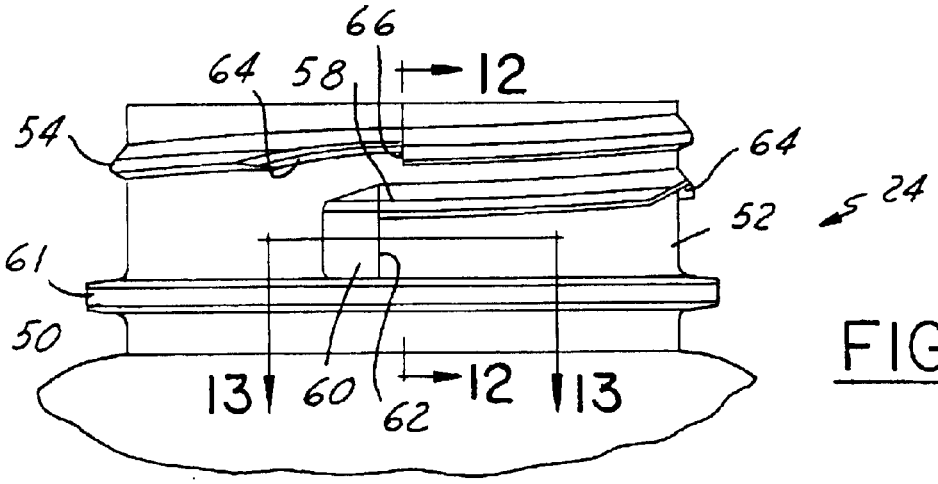
FIG. 11 is a fragmentary side elevational view of the container finish illustrated in FIG. 10.

A spring element 42 in the illustrated embodiment takes the form of a conical lip that extends axially and radially inwardly from base wall 26 adjacent to the junction of base wall 26 and peripheral skirt 28. Alternatively, spring lip 42 may extend axially and radially inwardly from the upper end of skirt 28 adjacent to the juncture with base wall 26. Spring lip 42 is circumferentially continuous, as best seen in FIG. 5, and tapers in thickness from base wall 26 to the free edge 44 of the lip. As best seen in FIGS. 8 and 9, free edge 44 of lip 42 is rounded—i.e., has a rounded convex contour facing axially downwardly with respect to base wall 26. The tapering contour of spring lip 42 promotes differential flexing of the spring lip, as will be described. Closure 22 illustrated in the drawings is of integral injection molded plastic construction, such as HDPE or PP. However, other plastic materials are also envisioned.

Figure 12:
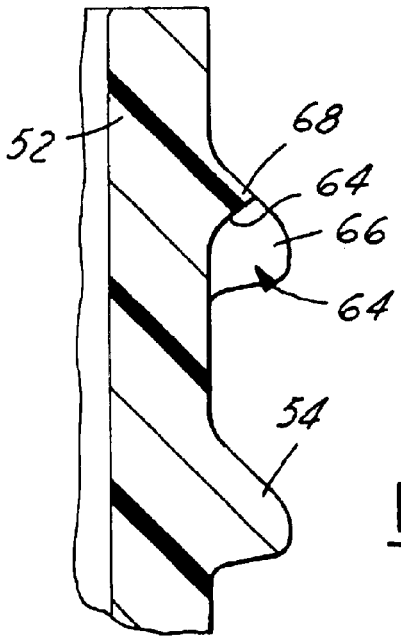
FIGS. 12 and 13 are fragmentary sectional views taken substantially along the lines 12—12 and 13—13 in FIG. 11.
Figure 13:
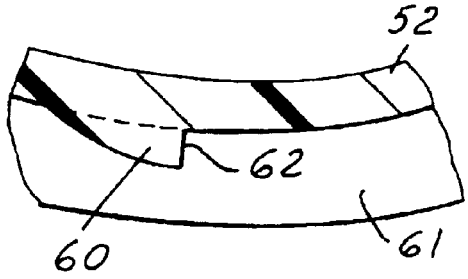

Container 24 (FIGS. 1–3 and 10–13) includes a hollow body 50 from which a finish 52 axially extends to form the container mouth. Finish 52 is cylindrical and has a central axis that is coincident with the central axis of closure skirt 28 in assembly. A helical external thread 54 extends around finish 52 from an upper end 56 to a lower end 58. A thread abutment stop 60 projects radially outwardly from finish 52 and extends axially (i.e., parallel to the central axis of the finish) from lower thread end 58 to a bead 61 that externally surrounds finish 52. Abutment stop 60 has a flat circumferentially facing face 62 disposed in the plane of the finish diameter. A series of pockets 64 are spaced around the underside or undersurface of thread 54. In the illustrated embodiment of the invention, there is a single external thread 54 having four pockets 64 at 90° spacing from each other, with the first pocket being disposed at a spacing of 90° from thread start 56. Each pocket 64 has a circumferentially oriented abutment face 66 and an angulated cam face 68. Each abutment face 66 is flat and disposed in a plane that includes the axis of the finish. In a preferred embodiment of the invention illustrated in the drawings, each pocket 64 follows the thread helix angle for about 10°, and then tangentially tapers into the thread over an angle of about 25°. It will be particularly noted in FIG. 12 that each pocket 64 does not extend axially entirely through thread 54, leaving a portion 68 contiguous with the upper surface of the thread, so that the upper surface of thread 54 is continuous throughout the length of the thread. This feature helps prevent jamming of the closure on the thread as the closure is applied to the container. Container 24 is preferably of integrally molded construction, such as HDPE, PP or PET.

A liner 70 is preferably disposed between closure spring lip 42 and the upper edge of container finish 52, at least when the package is initially assembled. Liner 70 in the embodiment of FIGS. 1–13 comprises a disk having sequential layers of cellulose 72, wax 74, metal 76 and plastic 78. (These layers are not illustrated to scale in the drawings.) Liner disks of this type are conventional in and of themselves. Liner 70 is in axial abutment with the upper edge or sealing surface of container finish 52, being held against the container by resilient compression of spring lip 42. As previously noted, the tapering contour of spring lip 42 helps promote differential flexing of the spring lip. That is, upon initial engagement of liner disk 70, the thinner free edge of the spring lip will initially deflect, and the base portion of the spring lip will not deflect until substantial additional force is applied. The rounded contour of spring lip free edge 44 helps promote sliding of the spring lip along the upper surface of the liner without gouging or tearing.

Liner 70 may be initially assembled to closure 22, and preferably is of a diameter to be loosely retained within the closure by the upper reach of closure internal thread 30. Alternatively, liner 70 may have a greater diameter than closure skirt 28 and be held by friction within the closure skirt. When container 24 is filled with product, and the closure and liner subassembly is assembled to the container, conventional induction equipment is employed to heat metal layer 76, vaporize wax layer 74 and melt plastic layer 78 so as to secure the metal and plastic layers to the upper edge of container finish 52. When closure 22 is thereafter removed from the container by a user, cellulose layer 72 is removed with the closure, while metal layer 76 and plastic layer 78 remain with the container for removal by the user. This not only seals the contents of the container until ready for use, but provides an indication to the user of potential tampering. Cellulose layer 72 remains in the closure loosely or frictionally captured between the closure base wall and the upper reach of the thread. Layer 72 provides a sealing function during continued use of the package.

When the closure is applied to the container, both at the time of filling and during use, lugs 36 on closure thread 30 enter and ride under pockets 64 in container external thread 54. Cam surfaces 40 on lugs 36 cooperate with cam surfaces 68 in pockets 64 to facilitate threading of the closure onto the container. As previously noted, the fact that pockets 64 do not extend fully through the finish external thread also helps prevent crossing of the threads. When the closure is fully applied to the container, spring lip 42 urges closure 22 axially upwardly with respect to the container finish so that lugs 36 nest within pockets 64. When it is thereafter attempted to remove the closure from the container finish, lug abutment faces 38 will cooperate with pocket abutment faces 60 to prevent unscrewing of the closure in the absence of sufficient axial force on the closure to compress spring lip 42 and permit the lugs to clear the pockets. This structure provides the child-resistant feature of the invention.

In the embodiment of the invention illustrated in FIGS. 1–13, the circumferential dimensions of closure internal thread 30 and finish external thread 54 are greater than the one-turn thread dimensions recommended by the Closure Manufacturers Association and the Society of the Plastics Industry. The spiral threads preferably both extend at least 450° around the closure and the container finish. In one presently preferred single-thread embodiment with thread stop 60 disposed at the lower end of finish thread 54, the closure thread extends over an arc of 450° and the finish thread extends over an arc of 455°. Thread abutment stop 60 on container finish 52 (FIGS. 10–11 and 13) cooperates with stop face 34 (FIGS. 4–6) on closure internal thread 30 to prevent over-tightening of the closure on the container finish, and possible damage to spring lip 42 due to over compression. The elongated dimension of container external thread 54 permits the container to be used with a non-child-resistant closure, for example, by the elderly who may have difficulty opening the child-resistant closure. The continuous internal thread on the non-child-resistant closure will readily bridge pockets 64 on the container finish. The extended finish thread length will ensure that the closure thread (typically about 360° in total length) does not engage and potentially jam on container finish thread stop 60.

Figure 14:
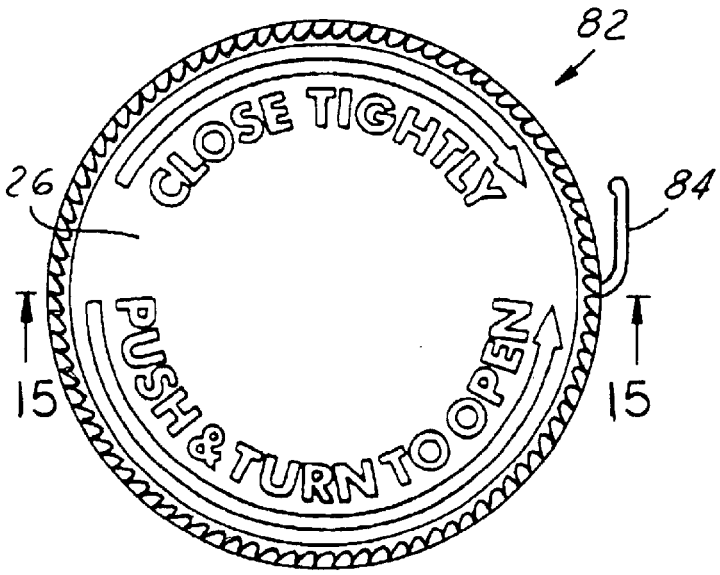
FIG. 14 is a top plan view of a closure in accordance with a modified embodiment of the invention.
Figure 16:
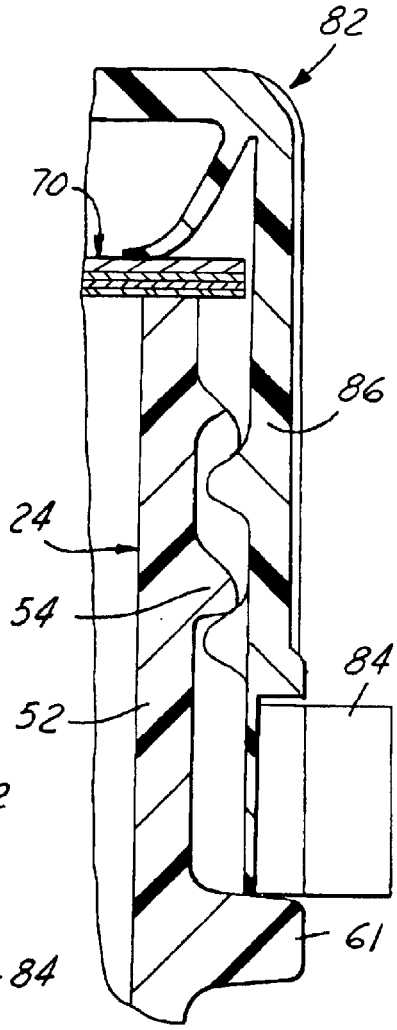
FIG. 16 is an enlarged sectional view of the portion of FIG. 15 within the area 16.
Figure 15:
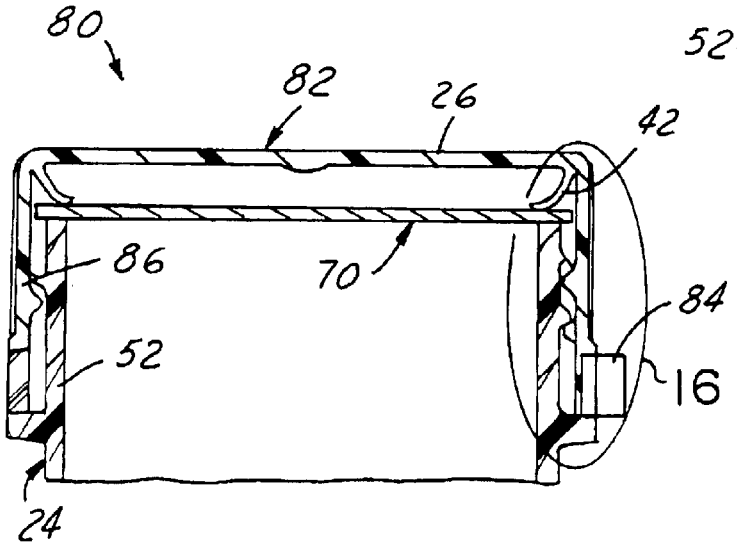
FIG. 15 is a fragmentary sectional view similar to that of FIG. 2 but illustrating the closure of FIG. 14.
Figure 17:
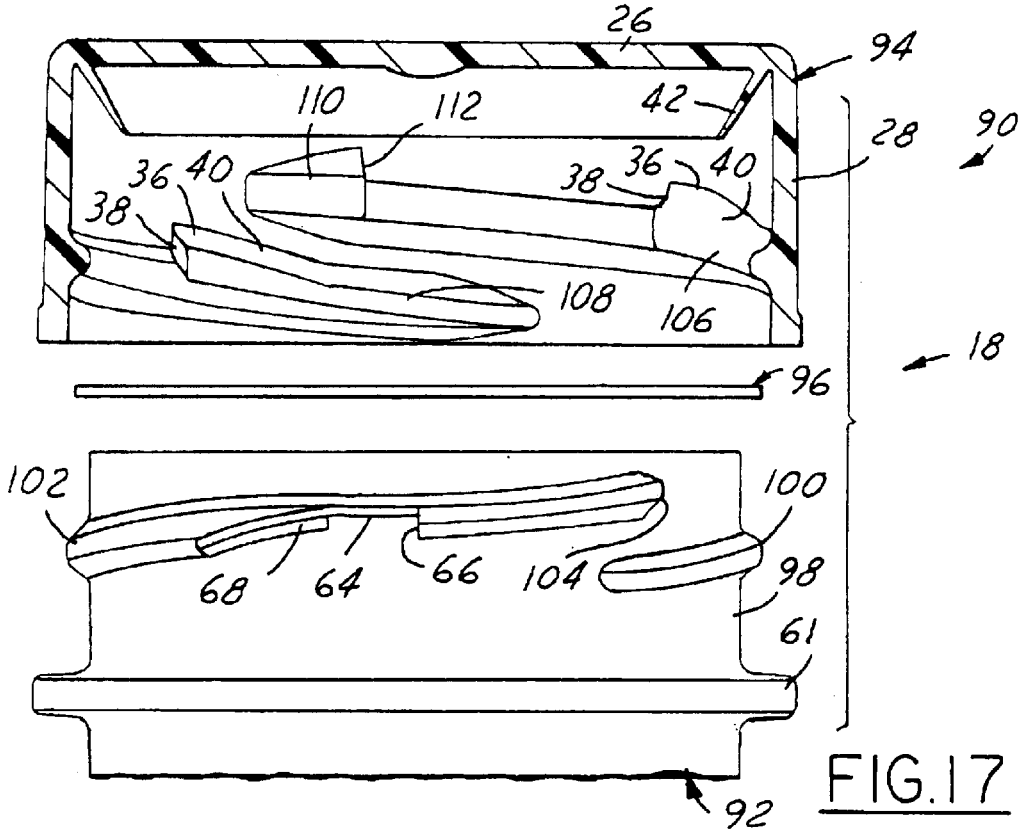
FIG. 17 is a partially sectioned exploded elevational view of a container finish, liner and closure in accordance with another embodiment of the invention.
Figure 18:
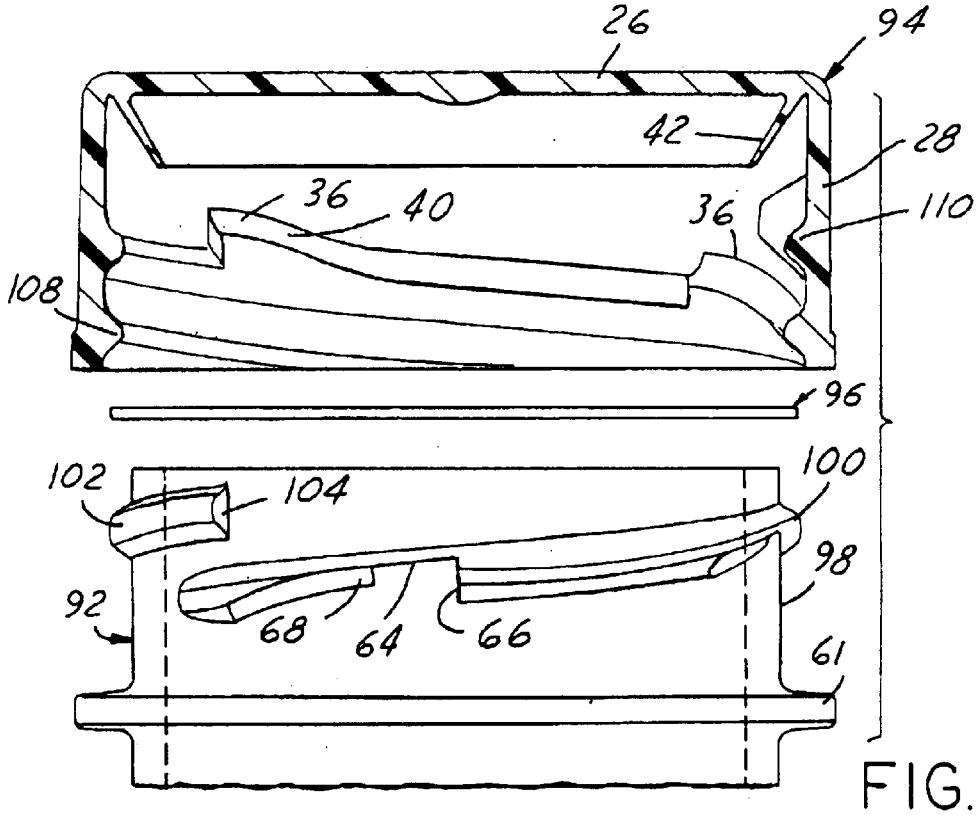
FIG. 18 is a partially sectioned elevational view taken from the direction 18 in FIG. 17.
Figure 19:
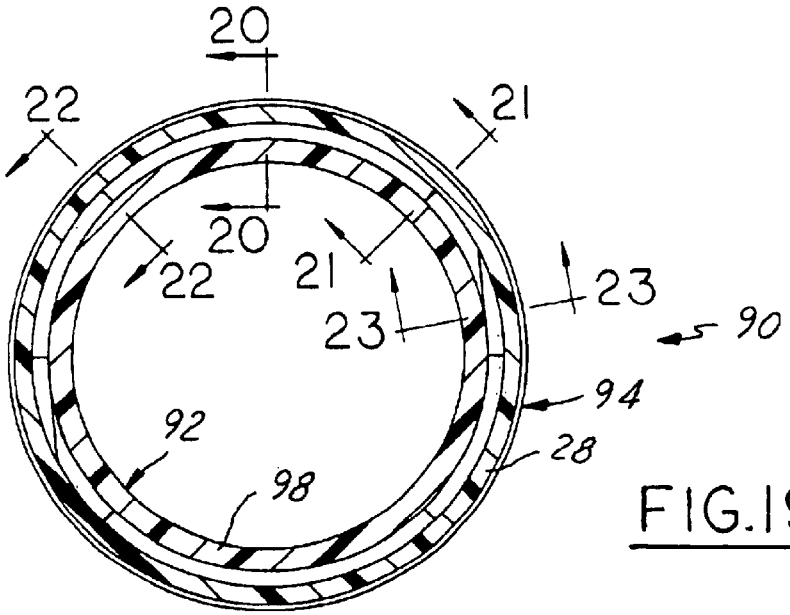
FIG. 19 is a sectioned elevational view taken in a plane extending through the closure and container finish in FIG. 17 perpendicular to the axis of the finish.
Figure 20:
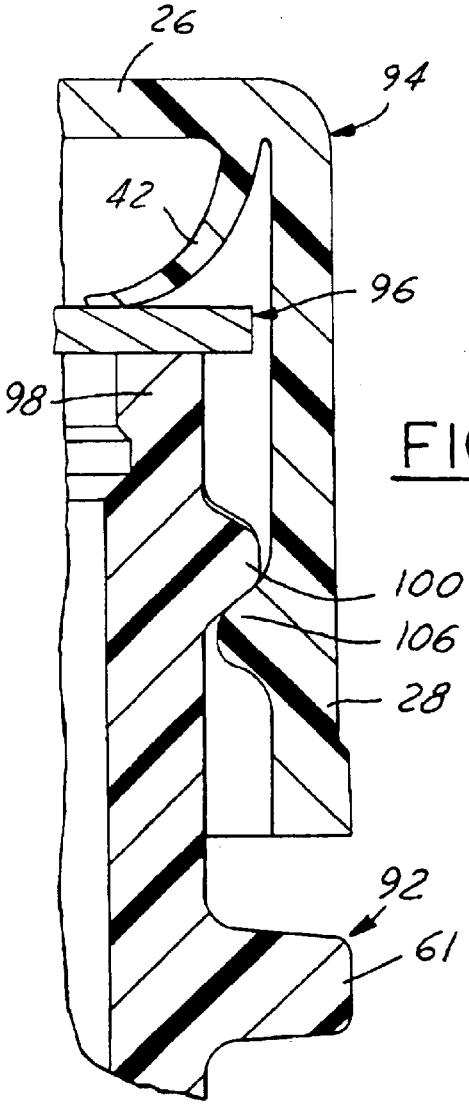
FIGS. 20–23 are sectional views taken along the respective lines 20—20,21—21,22—22 and 23—23 in FIG. 19.

FIGS. 14–16 illustrate a closure and container package 80 in accordance with a modified embodiment of the invention. Package 80 includes a closure 82 secured to finish 52 of container 24. The primary difference between package 80 in FIGS. 14–16 and package 20 in FIGS. 1–13 lies in the fact that a tear band 84 is integrally molded onto the lower edge of closure peripheral skirt 86, being secured thereto by frangible bridges or a thin frangible membrane. Tear band 84 extends from the lower edge of skirt 86 to a position adjacent to bead 61 on container finish 52. Thus, closure 82 cannot be axially compressed with respect to container finish 52 in order to remove the closure without first removing tear band 84 from the lower edge of the closure. Tear band 84 thus provides a tamper-indicating capability to the package 80 illustrated in FIGS. 14–16. The tear band also removes top load forces from spring lip 42 to prevent damage to the spring lip under long term top load conditions. The remainder of package 80 is the same as package 20, and identical reference numerals are employed in the drawings to indicate identical parts.

FIGS. 17–23 illustrate a container and closure package 90 in accordance with another embodiment of the invention as comprising a container 92, a closure 94 and a liner 96. Container 92 has a cylindrical finish 98 with dual external threads 100, 102. Each thread 100, 102 has two circumferentially spaced pockets 68 with abutment faces 66 as previously described. The pockets in each thread are at 90° spacing from each other, and the pockets in thread 100 are substantially diametrically opposed to the pockets in thread 102. Each thread 100, 102 preferably extends over an arc of at least 180°, plus a 10° lead-in. The upper end of each thread 100, 102 terminates in a circumferentially facing flat abutment face 104. Abutment faces 104 preferably lie in a common plane that intersects the central axis of the container finish.

Closure 94 in this embodiment has a base wall 26, a peripheral skirt 28 and a spring lip 42 as in the previous embodiments. Closure 94 is a dual-thread closure, containing a pair of internal threads 106, 108. Each internal thread preferably extends over an arc of 190°, plus a 10° lead-in. Each thread 106, 108 includes a circumferentially spaced pair of lugs 36 with circumferentially oriented abutment surfaces 38 and sloping cam surfaces 40 as previously described. Lugs 36 are at 90° spacing. The upper end of each thread—i.e., the end adjacent to closure base wall 26—terminates in an axially upwardly extending thread abutment stop 110. Each abutment stop projects radially inwardly from skirt 28 and has a circumferentially facing abutment stop face 112 opposed to the stop face 38 of the adjacent lug 36 on that thread. When the closure is threaded onto the container, abutment face 112 of stop 110 cooperates with abutment face 104 at the upper end of each external thread 100, 102 to prevent over-tightening of the closure onto the container and potential damage to spring element 42.

Figure 21:
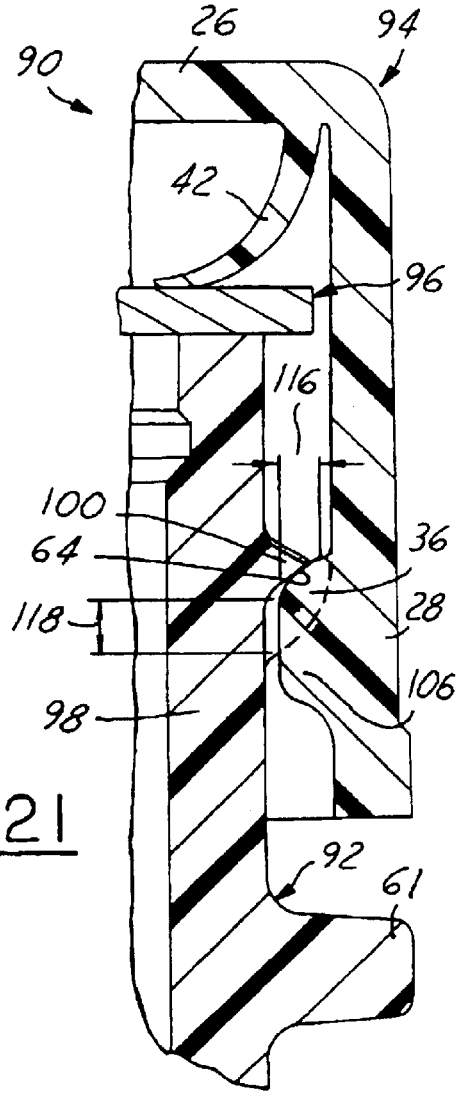
Figure 22:
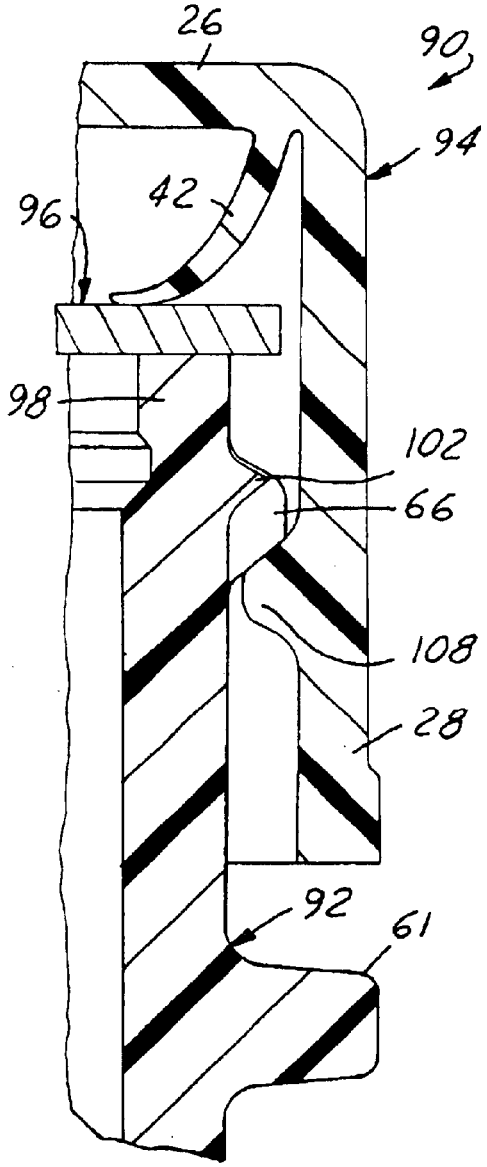
Figure 23:
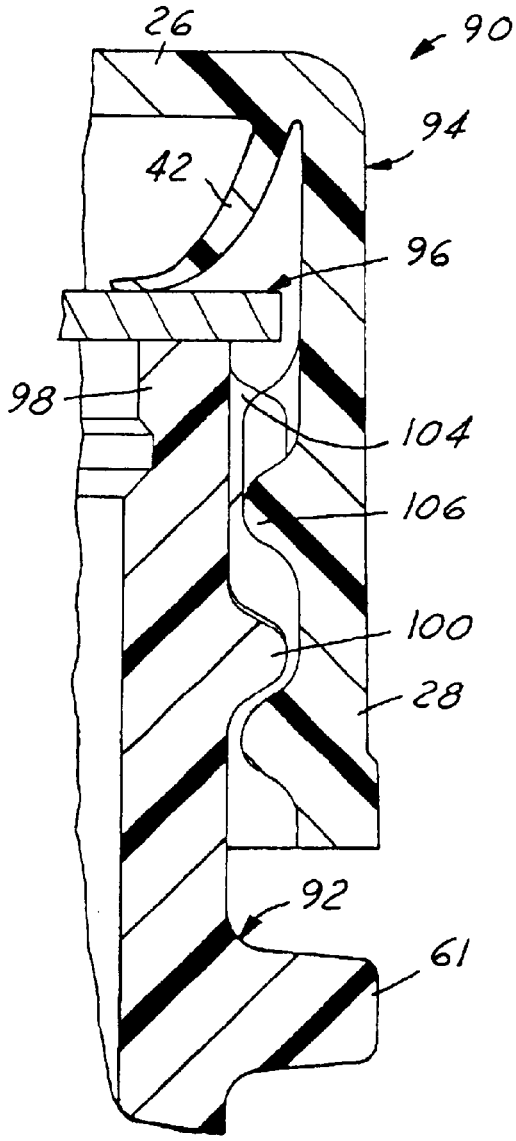

Liner 96 in the embodiment of FIGS. 17–23 is either a single-layer or multiple-layer liner that is not welded or otherwise secured to the container finish. Liner 96 may comprise a single layer of cellulose, for example. In assembly, liner 96 is captured within closure 94 by internal threads 106, 108 adjacent to base wall 26 of the closure. When the closure is applied to the container, liner 96 seals against the axial edge of closure finish 98. When the closure is removed from the container finish, the liner stays with the closure. FIG. 21 illustrates the amount 116 of radial overlap between lugs 36 on the closure internal thread and pockets 64 on the container finish external thread. FIG. 21 also illustrates the distance 118 that closure 94 must be depressed against the force of spring lip 42 in order for lugs 36 to clear pockets 64. The embodiment of FIGS. 17–23 has the advantage that formation of the opposing thread stops adjacent to the upper end of the closure thread helps to reduce over-torquing the closure caused by bypassing the thread stops due to ovalization.

Figure 24:
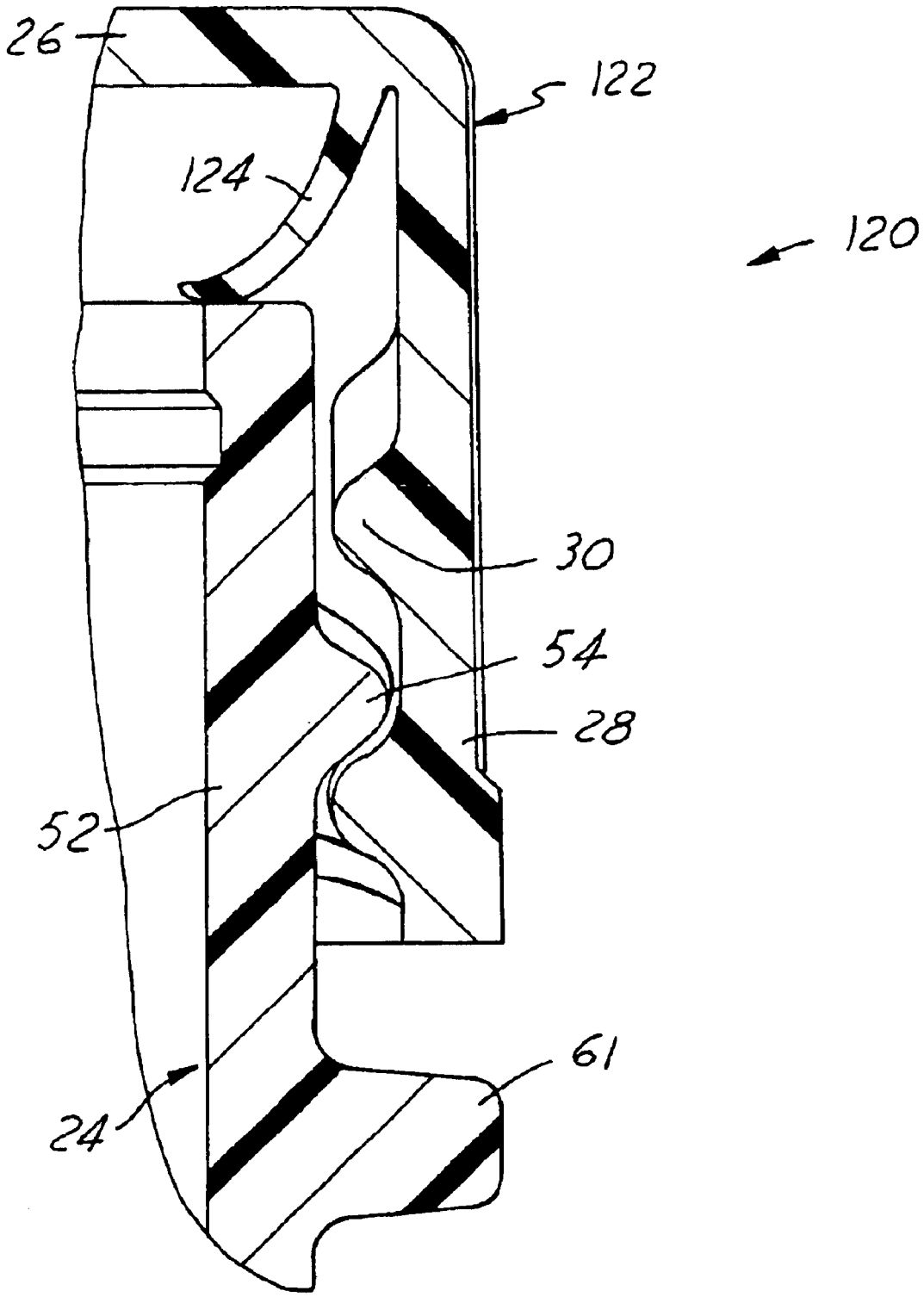
FIG. 24 is a fragmentary sectional view similar to that of FIG. 3, but illustrating another embodiment of the invention.

FIG. 24 illustrates a package 120 that is similar to those previously discussed, but in which the liner has been eliminated. Closure 122 of package 120 has a spring lip 124 that is compressed against finish 52 of container 24. Spring lip 124 is similar to lip 42 discussed above, but is designed to achieve the desired compression of the spring lip without the liner being present. Spring lip 42 also obtains a measure of sealing against the container finish.

There have thus been disclosed a child-resistant closure and container package, a closure, a container, and a method of making a child-resistant closure and container package, which fully satisfy all of the objects and aims previously set forth. Three embodiments of the invention have been disclosed, and a number of modifications and variations have been discussed. Other modification and variations will readily suggest themselves to persons of ordinary skill in the art. The invention is intended to embrace all such modifications and variations as fall within the spirit and broad scope of the appended claims.

What is claimed is:

1. A child-resistant closure and container package that includes:

a container having as finish with at least one external thread and angularly spaced pockets in said at least one external thread, and a closure having a base wall, a peripheral skirt with at least one internal thread, angularly spaced lugs on said at least one internal thread for receipt in said pockets, a spring element for engagement with said finish to bias said closure away from said finish end urge said lugs into said pockets, and a liner disk separate from said spring element and urged by said spring element into engagement with said finish, one of said internal thread and said external thread having a circumferentially facing stop extending axially from an end of said one thread, and the other of said internal thread and said external thread having an abutment face at an end of said other thread for abutment with said stop to prevent over-tightening of said closure on said finish and over-compression of said spring element, said at least one internal thread and said at least one external thread both being continuous threads, and said lugs on said at least one internal thread being equal in number to said pockets in said at least one external thread, said pockets in said at least one external thread not extending axially through said thread such that an upper surface of said at least one external thread is continuous, said liner disk being loosely captured by said at least one internal thread within said closure adjacent to said base wall, and including a base with metal and plastic layers adapted for induction sealing securement to said finish such that, upon removal of said closure, said metal and plastic layers remain secured to said finish and said liner base is removed with said closure.

2. The package set forth in claim 1 wherein said axially extending stop extends from a lower end of said external thread, and said internal and external threads are single threads that extend for at least 450°.

3. The package set forth in claim 1 wherein said axially extending stop extends from an upper end of said internal thread, and said internal and external threads are dual threads, with each thread extending for at least 180°.

4. The package set forth in claim 1 wherein said abutment face is flat.

5. The package set forth in claim 4 wherein said flat abutment face is disposed in a plane diametrically of said closure.

6. The package set forth in claim 5 wherein said stop extends from a lower end of said at least one external thread and projects radially outwardly from said finish, and said abutment face is disposed at a lower end of said at least one internal thread.

7. The package set forth in claim 5 wherein said stop extends from an upper end of said at least one internal thread adjacent to said base wall and projects radially inwardly from said skirt, and said abutment face is disposed at an upper end of said at least one external thread.

8. The package set forth in claim 1 wherein said pockets and said lugs have opposed angulated surfaces to cam said lugs over said pockets during application of said closure to said finish, and opposed abutment surfaces to resist removal of said closure absent pressure on said spring element.

9. The package set forth in claim 1 wherein said closure, including said spring element, is of one-piece integrally molded plastic construction.

10. The package set forth in claim 9 wherein said spring element comprises a circumferentially continuous conical lip that extends radially and axially inwardly from said base wall adjacent to said skirt, said lip tapering in thickness from said base wall to a free end of said lip.

11. The package set forth in claim 10 wherein said lip has a rounded free edge for engagement with said container finish.

12. A child-resistant closure and container package that includes;

a container having a finish with at least one continuous external thread and angularly spaced pockets on an undersurface of said at least one external thread that do not extend axially through said thread such that an upper surface of said external thread is continuous throughout said external thread, and a closure having a base wall, a peripheral skirt with at least one continuous internal thread and angularly spaced lugs on said at least one internal thread for receipt in said pockets, a spring element for engagement with said finish to bias said closure away from said finish and urge said lugs into said pockets, and a liner disk urged by said spring element into engagement with said finish, said lugs on said at least one continuous internal thread being equal in number to said pockets in said at least one external thread, said liner disk including a base with metal and plastic layers adapted for induction sealing securement to said finish such that, upon removal of said closure, said metal and plastic layers remain secured to said finish and said liner base is removed with said closure.

13. The package as set forth in claim 12 wherein said pockets and said lugs have opposed angulated surfaces to cam said lugs over said pockets during application of said closure to said finish, and opposed abutment surfaces to resist removal of said closure absent pressure on said spring element.

14. The package set forth in claim 12 wherein one of said internal thread and said external thread having a circumferentially facing stop extending axially from an end of said one thread, and the other of said internal thread and said external thread having an abutment face at an end of said other thread for abutment with said stop to prevent over-tightening of said closure on said finish and over-compression of said spring element.

15. The package set forth in claim 14 wherein said stop extends from a lower end of said at least one external thread and projects radially outwardly from said finish, and said abutment face is disposed at a lower end of said at least one internal thread.

16. The package set forth in claim 14 wherein said stop extends from an upper end of said at least one internal thread adjacent to said base wall and projects radially inwardly from said skirt, and said abutment face is disposed at an upper end of said at least one external thread.

17. The package set forth in claim 14 wherein internal and external threads are continuous single threads and extend for at least 450°.

18. The package set forth in claim 14 wherein said internal and external threads are dual threads, with each thread extending for at least 180°.

19. The package set forth in claim 12 wherein said closure, including said spring element, is of one-piece integrally molded plastic construction.

20. The package set forth in claim 19 wherein said spring element comprises a circumferentially continuous conical lip that extends radially and axially inwardly from said base wall adjacent to said skirt, said lip tapering in thickness from said base wall to a free end of said lip.

21. The package set forth in claim 20 wherein said lip has a rounded free edge for engagement with said container finish.

22. The package set forth in claim 19 wherein said liner disk is loosely captured by said at least one internal thread within said closure adjacent to said base wall.

23. A closure that includes an integrally molded one-piece plastic body having: (a) a base wall, (b) a peripheral skirt with at least one continuous internal thread and plural lugs on an upper surface of said thread, each said lugs having an angulated surface sloping toward an end of said thread remote from said base wall and a circumferentially facing radially extending abutment surface on an end of said lugs facing an opposing end of said thread, (c) a spring element for engagement with a container finish to bias said lugs into opposing pockets on the container finish, and (d) a liner captured between said thread and said spring element, said liner including sequential layers of cellulose, wax, metal and plastic, with said wax layer evaporating and said plastic layer melting upon application of induction current to said metal layer.

24. The closure set forth in claim 23 wherein said spring element comprises a circumferentially continuous conical lip that extends radially and axially inwardly from said base wall adjacent to said skirt, said lip tapering in thickness from said base wall to a free end of said lip for differential flexing upon engagement with a container finish.

25. The closure set forth in claim 24 wherein said at least one internal thread is a single thread that extends continuously for at least 450°.

26. The closure set forth in claim 24 wherein said at least one internal thread is a double thread, with each thread extending at least 180°.

27. The closure set forth in claim 23 wherein said at least one internal thread has an end remote from said base wall with a flat circumferentially facing radially extending end face.

28. The closure set forth in claim 23 wherein said at least one internal thread has a circumferentially facing axially extending stop projecting radially inwardly from said skirt and extending axially from an end of said thread adjacent to said base wall.

29. A child-resistant closure and container package that includes:

a container having a finish with at least one continuous external thread and pockets on an undersurface of said external thread that do not extend axially through said thread such that an upper surface of said external thread is continuous throughout said external thread, a closure of one-piece molded plastic construction having a base wall, a peripheral skirt with at least one continuous internal thread and lugs on said internal thread for receipt in said pockets, and a spring element for engagement with said finish to bias said closure away from said finish and urge said lugs into said pockets, and a liner disk loosely captured by said at least one internal thread within said closure adjacent to said base wall and adapted to be urged by said spring element into engagement with said finish, said liner disk including a base with metal and plastic layers adapted for induction sealing securement to said finish such that, upon removal of said closure, said metal and plastic layers remain secured to said finish and said liner base is removed with said closure.

30. The package set forth in claim 29 wherein said spring element comprises a circumferentially continuous conical lip that extends radially and axially inwardly from said base wall adjacent to said skirt, said lip tapering in thickness from said base wall to a free end of said lip.

31. The package set forth in claim 30 wherein said lip has a rounded free edge for engagement with said liner disk.

* * * * *